US007789140B2

(12) United States Patent
Noel, Jr.

(10) Patent No.: US 7,789,140 B2
(45) Date of Patent: Sep. 7, 2010

(54) SYSTEM AND METHOD FOR RADIALLY EXPANDING AND PLASTICALLY DEFORMING A WELLBORE CASING

(75) Inventor: Gregory Marshall Noel, Jr., Katy, TX (US)

(73) Assignee: Enventure Global Technology, LLC, Houston, TX (US)

( * ) Notice: Subject to any disclaimer, the term of this patent is extended or adjusted under 35 U.S.C. 154(b) by 161 days.

(21) Appl. No.: 12/271,491

(22) Filed: Nov. 14, 2008

(65) Prior Publication Data

US 2009/0126944 A1 May 21, 2009

Related U.S. Application Data

(60) Provisional application No. 60/988,613, filed on Nov. 16, 2007.

(51) Int. Cl.
*E21B 23/00* (2006.01)

(52) U.S. Cl. ..... 166/207

(58) Field of Classification Search ..... 166/380, 166/384, 207

See application file for complete search history.

(56) References Cited

U.S. PATENT DOCUMENTS 7,252,142 B2 * 8/2007 Brezinski et al. ..... 166/191
7,303,023 B2 * 12/2007 Harrall et al. ..... 166/384
7,410,001 B2 * 8/2008 Harrall et al. ..... 166/380
7,597,140 B2 * 10/2009 Filippov et al. ..... 166/207
2005/0230103 A1 * 10/2005 Cook et al. ..... 166/207
2006/0090903 A1 * 5/2006 Gano et al. ..... 166/384
2008/0023194 A1 * 1/2008 Noel et al. ..... 166/208
2008/0142213 A1 * 6/2008 Costa et al. ..... 166/250.01

* cited by examiner

*Primary Examiner*—William P Neuder
*Assistant Examiner*—Catherine Loikith
(74) *Attorney, Agent, or Firm*—Derek V. Forinash

(57) ABSTRACT

A system for radially expanding an expandable tubular within a wellbore to form a wellbore casing. In some embodiments, the system includes a support member insertable within and displaceable relative to the expandable tubular, an expansion cone coupled to the support member, a tubular sleeve translatably disposed about the support member, an annular chamber between the tubular sleeve and the expandable tubular, and a tubular piston disposed in the annular chamber, the tubular piston dividing the annular chamber into a first chamber and a second chamber. The support member has a tubular body with an axial flowbore, a first radial passage, and a second radial passage. The tubular sleeve has a third and a fourth radial passage. The flowbore is in fluid communication with the first chamber when the first and third radial passages are aligned, and with the second chamber when the second and fourth radial passages are aligned.

28 Claims, 13 Drawing Sheets

SYSTEM AND METHOD FOR RADIALLY EXPANDING AND PLASTICALLY DEFORMING A WELLBORE CASING

CROSS REFERENCE TO RELATED APPLICATIONS

This application claims benefit of U.S. Provisional Application Ser. No. 60/988,613, filed Nov. 16, 2007, and entitled "System for Radially Expanding and Plastically Deforming a Wellbore Casing," which is hereby incorporated herein by reference in its entirety for all purposes.

STATEMENT REGARDING FEDERALLY SPONSORED RESEARCH OR DEVELOPMENT

Not applicable.

BACKGROUND OF THE INVENTION

This disclosure relates generally to hydrocarbon exploration and production, and in particular to forming well bore tubulars to facilitate hydrocarbon production or downhole fluid injection.

Conventionally, when a wellbore is created, a number of casings are installed in the borehole to prevent collapse of the borehole wall, and to prevent undesired outflow of drilling fluid into the surrounding formation and inflow of fluid from the formation into the borehole. The borehole is drilled in intervals. At each successive lower interval, a casing which is to be installed is lowered through previously installed casings at upper borehole intervals. As a consequence of this procedure, the casing of the lower interval is of smaller diameter than the casings of the upper intervals. Thus, the installed casings are in a nested arrangement with casing diameters decreasing in a downhole direction. Cement annuli are then provided between the outer surfaces of the installed casings and the borehole wall to seal the casings with the borehole wall.

As a consequence of the nested casing arrangement, a relatively large borehole diameter is required at the upper end of the wellbore to achieve the desired flowbore diameter extending downhole into the well. Such a large borehole diameter involves increased costs due to heavy casing handling equipment, large drill bits, and increased volumes of drilling fluid and drill cuttings. Moreover, increased drilling rig time is involved due to required cement pumping, cement hardening, equipment changes due to large variations in hole diameters drilled in the course of the well, and the large volume of cuttings drilled and removed.

The principles of the present disclosure are directed to overcoming one or more of the limitations of the existing systems and processes for increasing hydrocarbon production or fluid injection.

SUMMARY OF THE PREFERRED EMBODIMENTS

A system and associated methods for radially expanding an expandable tubular within a wellbore to form a wellbore casing are disclosed. In some embodiments, the system includes a support member insertable within and translatable relative to the expandable tubular, an expansion cone coupled to the support member, a tubular sleeve translatably disposed about the support member, and a tubular piston disposed between the tubular sleeve and the expandable tubular. The support member, the expandable tubular, the tubular piston, and the tubular sleeve form a chamber. The support member has a tubular body with a flowbore extending axially therethrough, an annular piston extending radially therefrom, and a first radial passage therethrough. The tubular sleeve has a second radial passage therethrough. The chamber is in fluid communication with the flowbore when the first and second radial passages are aligned.

In some embodiments, the system includes a support member insertable within and displaceable relative to the expandable tubular, an expansion cone coupled to the support member, a tubular sleeve translatably disposed about the support member, an annular chamber between the tubular sleeve and the expandable tubular, and a tubular piston disposed in the annular chamber, the tubular piston dividing the annular chamber into a first chamber and a second chamber. The support member has a tubular body with an axial flowbore, a first radial passage, and a second radial passage. The tubular sleeve has a third and a fourth radial passage. The flowbore is in fluid communication with the first chamber when the first and third radial passages are aligned, and with the second chamber when the second and fourth radial passages are aligned.

Some method embodiments include aligning the first and the third radial flow passages to establish fluid communication between the flowbore and the first chamber, injecting fluidic material from the flowbore into the first chamber, and displacing the support member relative to the expandable tubular, whereby the expansion cone radially expands a portion of the expandable tubular.

Thus, the disclosed system and associated methods include a combination of features and advantages that enable radial expansion of tubulars in a wellbore. These and various other characteristics and advantages of the preferred embodiments will be readily apparent to those skilled in the art upon reading the following detailed description and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF PREFERRED EMBODIMENTS

Figure 1:
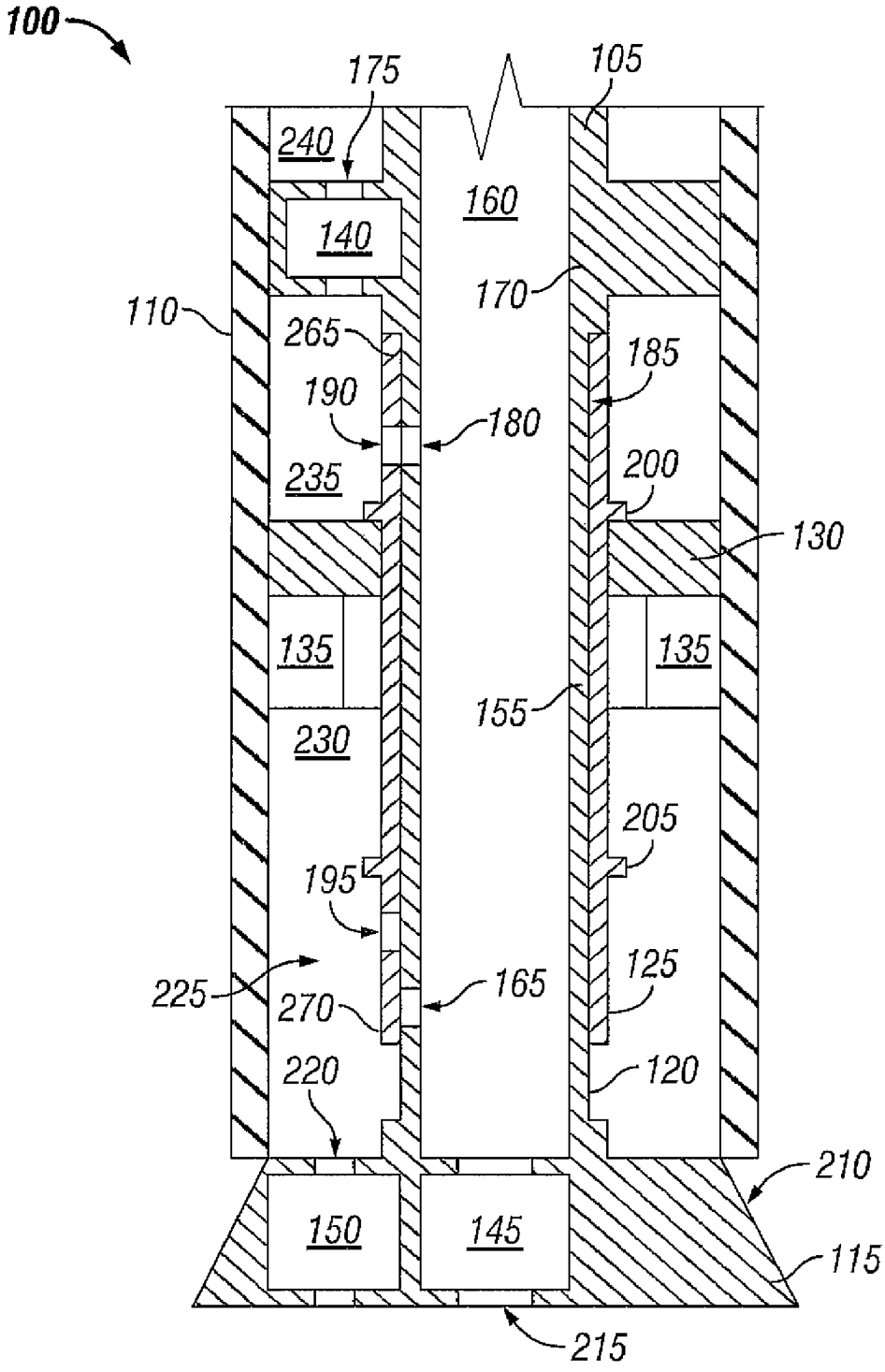
FIG. 1 depicts a cross-sectional view of a system for radially expanding and plastically deforming an expandable tubular in accordance with the principles disclosed herein.

Various embodiments of the invention will now be described with reference to the accompanying drawings, wherein like reference numerals are used for like parts throughout the several views. The figures are not necessarily to scale. Certain features of the invention may be shown exaggerated in scale or in somewhat schematic form, and some details of conventional elements may not be shown in the interest of clarity and conciseness.

In the following discussion and in the claims, the terms "including" and "comprising" are used hi an open-ended fashion, and thus should be interpreted to mean "including, but not limited to . . . ". Also, the terms "couple," "couples", and "coupled" used to describe any connections are each intended to mean and refer to either all indirect or a direct connection.

The preferred embodiments of the invention relate to systems and associated methods for radially expanding a tubular to form a wellbore casing. The invention is susceptible to embodiments of different forms. There are shown in the drawings, and herein will be described in detail, specific embodiments of the invention with the understanding that the present disclosure is to be considered an exemplification of the principles of the invention and is not intended to limit the invention to that illustrated and described herein. It is to be fully recognized that the different teachings of the embodiments discussed below may be employed separately or in any suitable combination to produce desired results.

Referring to FIG. 1, an embodiment of a system for radially expanding and plastically deforming a tubular member to form a wellbore casing is shown. System 100 includes a tubular support member 105 inserted within an expandable tubular 110, an expansion cone 115 coupled to the lower end 120 of tubular support member 105, a tubular sleeve 125 translatably disposed about tubular support member 105, a tubular piston 130 and one or more slips 135 coupled thereto disposed between tubular sleeve 125 and expandable tubular 110, and a plurality of flow control valves 140, 145, 150. In at least some embodiments, each of valves 140, 145, 150 is a conventional flow valve and electrically, mechanically, or hydraulically actuatable between an open position, permitting fluid flow therethrough, and a closed position, preventing fluid flow therethrough.

Tubular support member 105 is translatable relative to expandable tubular 110. Support member 105 has a tubular body 155 with an axial flowbore 160 extending therethrough. Tabular body 155 further includes a lower radial flow passage 165 proximate lower end 120, an annular piston 170 extending radially outward from tubular body 155, an upper radial flow passage 180 below piston 170, and an external recess 185 extending between annular piston 170 and lower end 120. Annular piston 170 sealingly engages expandable tubular 110 and has an axial flow passage 175 extending therethrough. Flow control valve 140 is actuatable to control, including prevent, fluid flow through flow passage 175.

Tubular sleeve 125 is disposed within external recess 185 of tubular support member 105 and translatable about support member 105 within external recess 185 between lower end 120 and annular piston 170. Sleeve 125 includes an upper radial flow passage 190 proximate its upper end 265 and a lower radial flow passage 195 proximate its lower end 270. Sleeve 125 is translatable about support member 105 to align radial flow passages 180, 190 (radial flow passages 165, 195), thereby establishing fluid communication through passages 180, 190 (passages 165, 195) between flowbore 160 of support member 105 and an annular chamber 225 between sleeve 125 and expandable tubular 110. As used herein, the term "align" means the axial position of at least a portion of passage 180 passage 165) is substantially the same as the axial position of at least a portion of passage 190 (passage 195) such that fluid may pass through passages 180, 190 (passages 165, 195), and fluid communication is established through passages 180, 190 (passages 165, 195) between flowbore 160 of support member 105 and chamber 225. Moreover, the term "misalign" means the axial position of passage 180 (passage 165) is substantially different than the axial position of passage 190 passage 195) such that fluid may not pass through passages 180, 190 (passages 165, 195), and there is no fluid communication through passages 180, 190 (passages 165, 195) between flowbore 160 and chamber 225.

Thus, when sleeve 125 translates about tubular support member 105 and radial flow passage 180 of support member 105 aligns with radial flow passage 190 of sleeve 125, fluid may pass through passages 180, 190, and fluid communication is established between flowbore 160 and chamber 225 through passages 180, 190. However, when radial passages 180, 190 are misaligned, fluid may not pass through passages 180, 190, and there is no fluid communication between flowbore 160 and chamber 225 through passages 180, 190. Similarly, when sleeve 125 translates about tubular support member 105 and radial flow passage 165 of support member 105 aligns with radial flow passage 195 of sleeve 125, fluid may pass through passages 165, 195, and fluid communication is established between flowbore 160 and chamber 225 through passages 165, 195. When radial passages 165, 195 are misaligned, fluid may not pass through passages 165, 195, and there is no fluid communication between flowbore 160 and chamber 225 through passages 165, 195. The spacing between radial flow passages 190, 195 and the spacing between radial flow passages 180, 165 are selected such that when sleeve 125 translates about tubular support member 105 and passage 190 of sleeve 125 aligns with passage 180 of support member 105, passage 195 of sleeve 125 and passage 165 of support member 105 are misaligned. Conversely, when sleeve 125 translates about support member 105 and passage 195 aligns with passage 165, passages 190, 180 are misaligned.

Sleeve 125 further includes an upper flanged portion 200 and a lower flanged portion 205. Tubular piston 130 is axially disposed between flanged portions 200, 205. Translational movement of sleeve 125 relative to tubular piston 130 is limited by flanged portions 200, 205. Further, piston 130 is axially translatable between expandable tubular 110 and sleeve 125. When piston 130 translates upward a sufficient distance relative to sleeve 125, piston 130 contacts flanged portion 200. Continued upward translation of piston 130 causes sleeve 125 by virtue of flanged portion 200 to translate with piston 130 until upper end 265 of sleeve 125 abuts tubular support member 105 proximate piston 170, at which point upward translation of these components 125, 130 ceases. Alternatively, when piston 130 translates downward a sufficient distance relative to sleeve 125, piston 130 contacts flanged portion 205. Continued downward translation of piston 130 causes sleeve 125 by virtue of flanged portion 205 to translate with piston 130 until lower end 270 of sleeve 125 abuts tubular support member 105 proximate end 120, at which point downward translation of these components 125, 130 ceases. Slips 135, coupled to piston 130, are actuatable to engage expandable tubular 110 and lock in position. When slips 135 are locked, slips 135 prevent downward axial translation of piston 130. However, sleeve 125 remains translatable in either direction relative to piston 130.

Expansion cone 115, coupled to lower end 120 of tubular support member 105, includes a tapered outer surface 210 and two axial flowbores 215, 220 extending therethrough. When expansion cone 115 is displaced within expandable tubular 110, as will be described, outer surface 210 engages expandable tubular 110. This engagement causes radial expansion and plastic deformation of expandable tubular 110 in the region of contact. Flowbores 215, 220 are coupled to flowbore 160 of tubular support member 105 and an annular chamber 225 between expandable tubular 110 and sleeve 125/tubular support member 105, respectively. Flow control valves 145, 150 are actuatable to control, including prevent, fluid flow through flowbores 215, 220, respectively. Thus, when valve 145 is open, fluid may pass through flowbore 215 either into or out of flowbore 160 of tubular support member 105. Similarly, when valve 150 is open, fluid may pass through flowbore 220 either into or out of chamber 225.

Pistons 130, 170 sealingly engage expandable tubular 110 and, in the case of piston 130, tubular support member 120, to separate chamber 225 into three smaller chambers 230, 235, 240. When valve 140 is open, fluid communication is permitted between chambers 235, 240. Also, when radial flow passages 180, 190 are aligned, fluid communication is established between flowbore 160 of tubular support member 105 and chamber 235 through passages 180, 190. At the same time, however, fluid communication between flowbore 160 and chamber 230 is prevented because passages 165, 195 are misaligned. Conversely, when radial flow passages 165, 195 are aligned, fluid communication is established between flowbore 160 and chamber 230 through passages 165, 195, while fluid communication between flowbore 160 and chamber 235 is prevented because passages 180, 190 are misaligned. Thus, by aligning passages 180, 190 or passages 165, 195 and actuating valves 140, 145, 150 between their open and closed positions, fluid may be directed through system 100 along various paths, as will be described.

To radially expand and plastically deform expandable tubular 110 tubular support member 105 with expansion cone 115, sleeve 125, piston 130 and slips 135 coupled thereto is inserted within expandable tubular 110, as shown. System 100 may then be positioned within a wellbore to expand tubular 110 to, for example, form a wellbore casing. Prior to positioning system 100 at the desired location with the wellbore, system 100 is configured to prevent damage to its components caused by excessive fluid pressures which may otherwise buildup as system 100 is lowered into the wellbore. Valves 145, 150 are actuated to their open positions to allow fluid flow through flowbores 215, 220, respectively. Valve 140 is actuated to its closed position to prevent fluid flow through axial flow passage 175 into chamber 240. Sleeve 125 is translated relative to tubular support member 105 to align radial passages 180, 190, thereby enabling fluid flow from flowbore 160 of tubular support member 105 through aligned passages 180, 190 into chamber 235. At the same time, fluid is prevented from entering chamber 230 from flowbore 160 due to misalignment of radial passages 165, 195. Piston 130 is positioned abutting upper flanged portion 200 of sleeve 125, and slips 135 actuated to lock in engagement with expandable tubular 110. System 100 is then ready for insertion into a wellbore.

Figure 2:
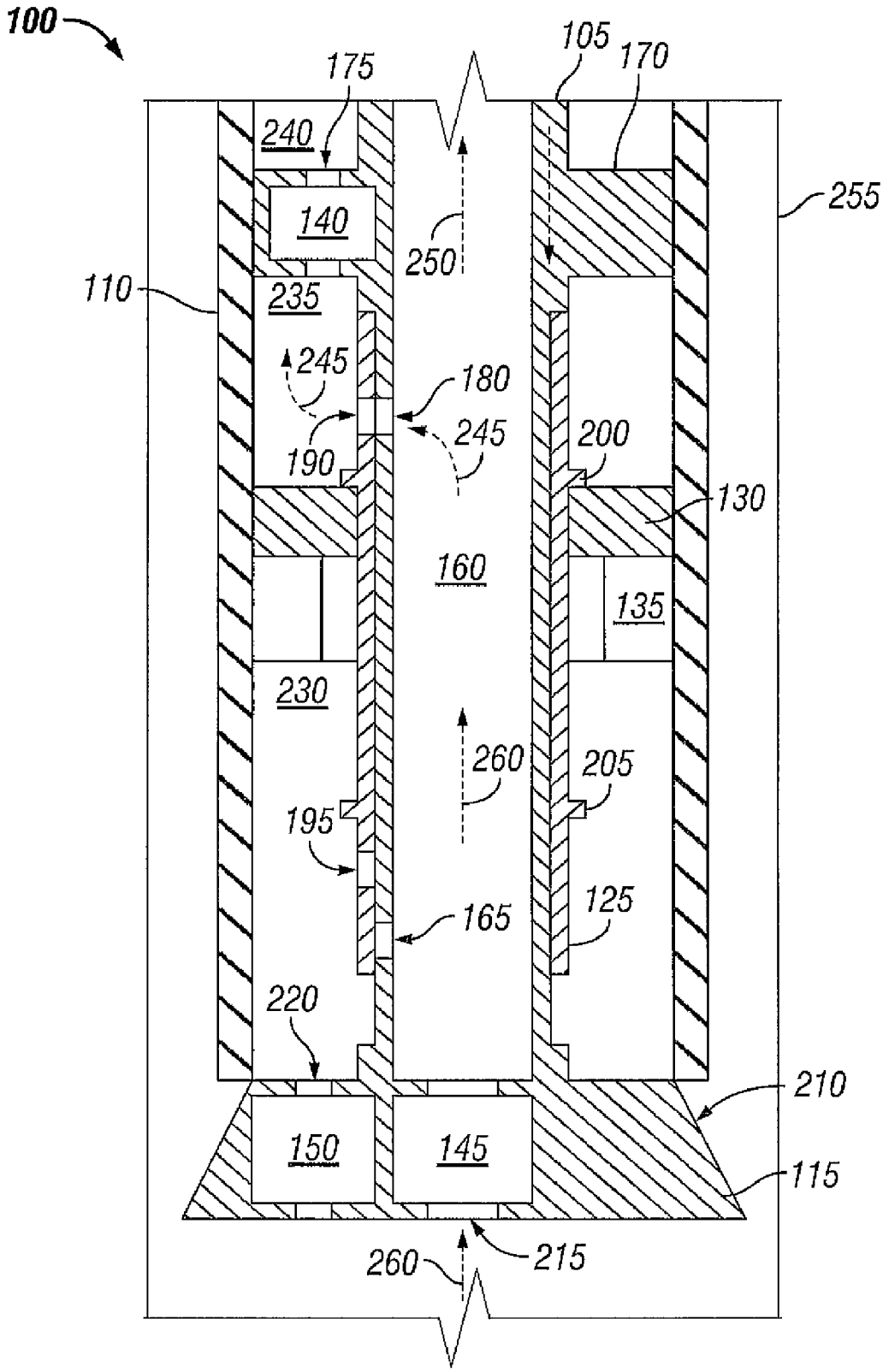
FIG. 2 depicts a cross-sectional view of the system of FIG. 1 inserted within a wellbore.

Referring to FIG. 2, as system 100 is lowered to the desired location within a wellbore 255, fluidic material 260 which has collected in wellbore 255 pass into system 100 through flowbore 215 of expansion cone 115. The fluidic material 260 then passes through system 100 along two paths 245, 250. At least some of the fluidic material 260 is conveyed along path 245 from flowbore 160 of tubular support member 105 through aligned passages 180, 190 into chamber 235. The remaining fluidic material 260 is simply conveyed along path 250 through flowbore 160, but not diverted through aligned passages 180, 190. By allowing fluidic material 260 to pass through system 100 in this manner, the buildup of excessive fluid pressure within system 100 may be avoided, thereby preventing damage to system 100 during insertion into wellbore 255.

Figure 3:
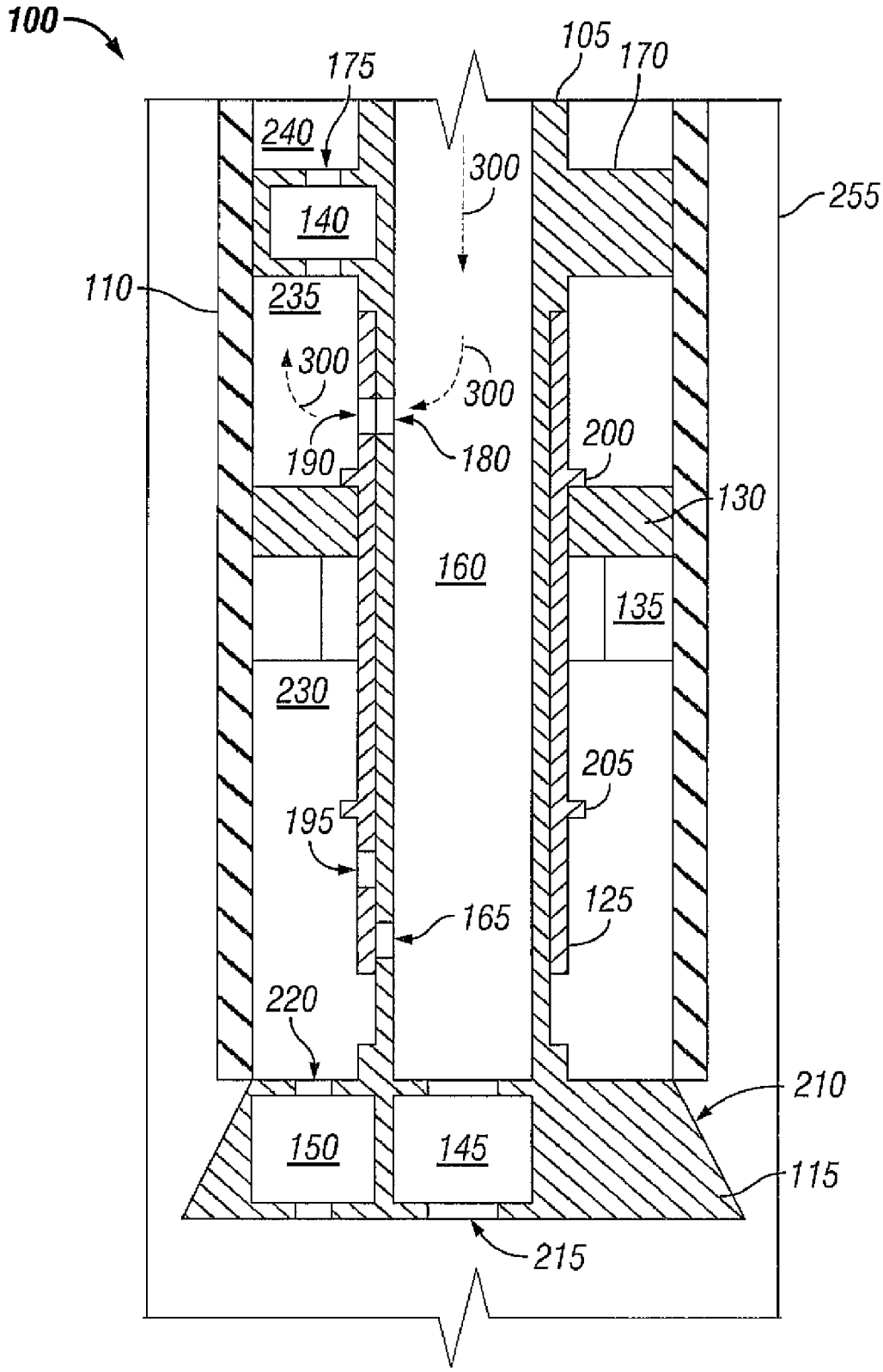
FIG. 3 depicts a cross-sectional view of the system of FIG. 1 positioned at the desired location within the wellbore prior to initiation of the expansion process.

Once system 100 is positioned at the desired location within wellbore 255, as illustrated by FIG. 3, tubular 110 may then be radially expanded and plastically deformed by displacing expansion cone 115 axially upward within expandable tubular 110. To initiate the expansion process, valves 140, 145 are actuated to their closed positions to prevent fluid flow through axial flow passage 175 and flowbore 215, respectively. Valve 150 is actuated to its open position to allow fluid flow through flowbore 220. Fluidic material 300 is then injected into flowbore 160 of tubular support member 105 from the surface. Because valve 145 is closed and radial passages 165, 195 are misaligned, the fluidic material 300 is forced through aligned passages 180, 190 into chamber 235. As fluidic material 300 accumulates in chamber 235, the pressure of that material 300 builds because valve 140 is closed.

Figure 4:
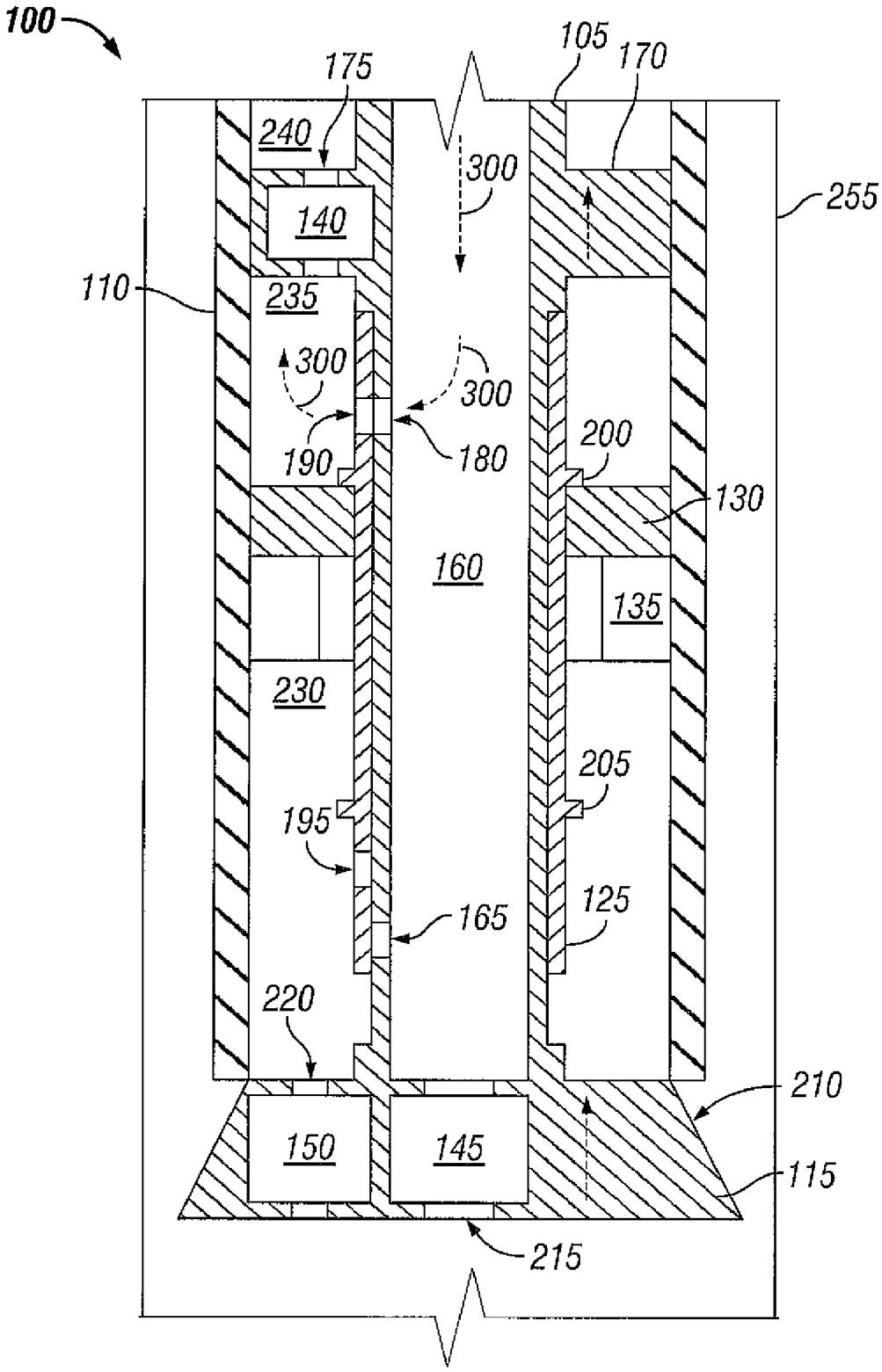
FIG. 4 depicts a cross-sectional view of the system of FIG. 1 at the onset of the expansion process.
Figure 5:
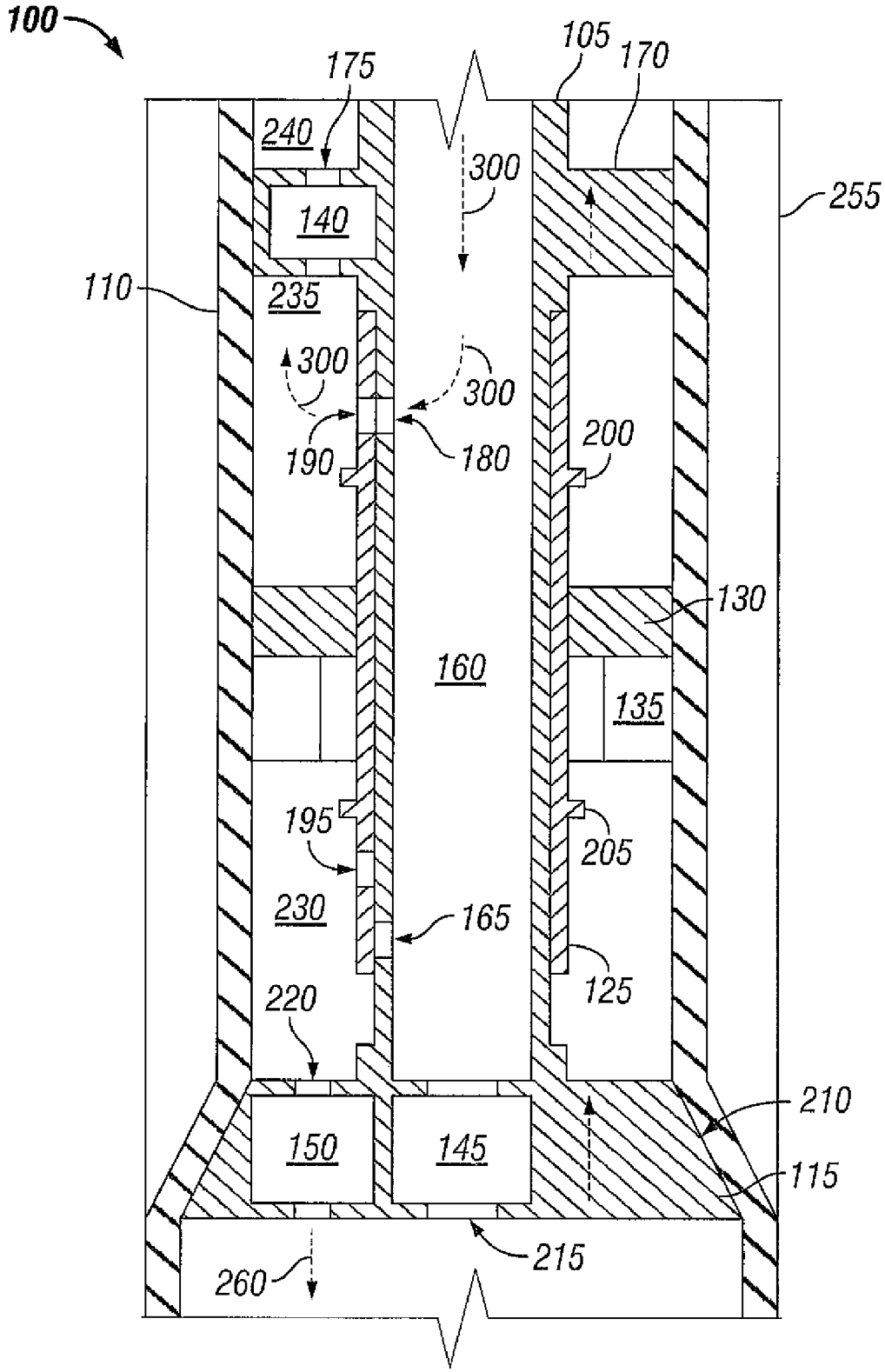
FIG. 5 depicts a cross-sectional view of the system of FIG. 1 as the expansion process progresses.

Turning to FIG. 4, when the force exerted on piston 170 by material 300 accumulated within chamber 235 exceeds the force required to expand and plastically deform expandable tubular 110, the weight of tubular support member 105 and other components 115, 125 coupled thereto, support member 105 begins to translate upward within expandable tubular 110. As a result, expansion cone 115 is displaced within expandable tubular 110, thereby radially expanding and plastically deforming tubular 110. At the same time, translation of expansion cone 115 within expandable tubular 110 causes the volume of chamber 230 to decrease, as illustrated by FIG. 5. Valve 150 is open during the expansion process to allow fluidic, material 260 within chamber 230 to pass from system 100 though flowbore 220 into wellbore 255 as the volume of chamber 230 decreases, thereby minimizing the resistance of fluidic material 260 within chamber 230 to upward movement of expansion cone 115.

Figure 6:
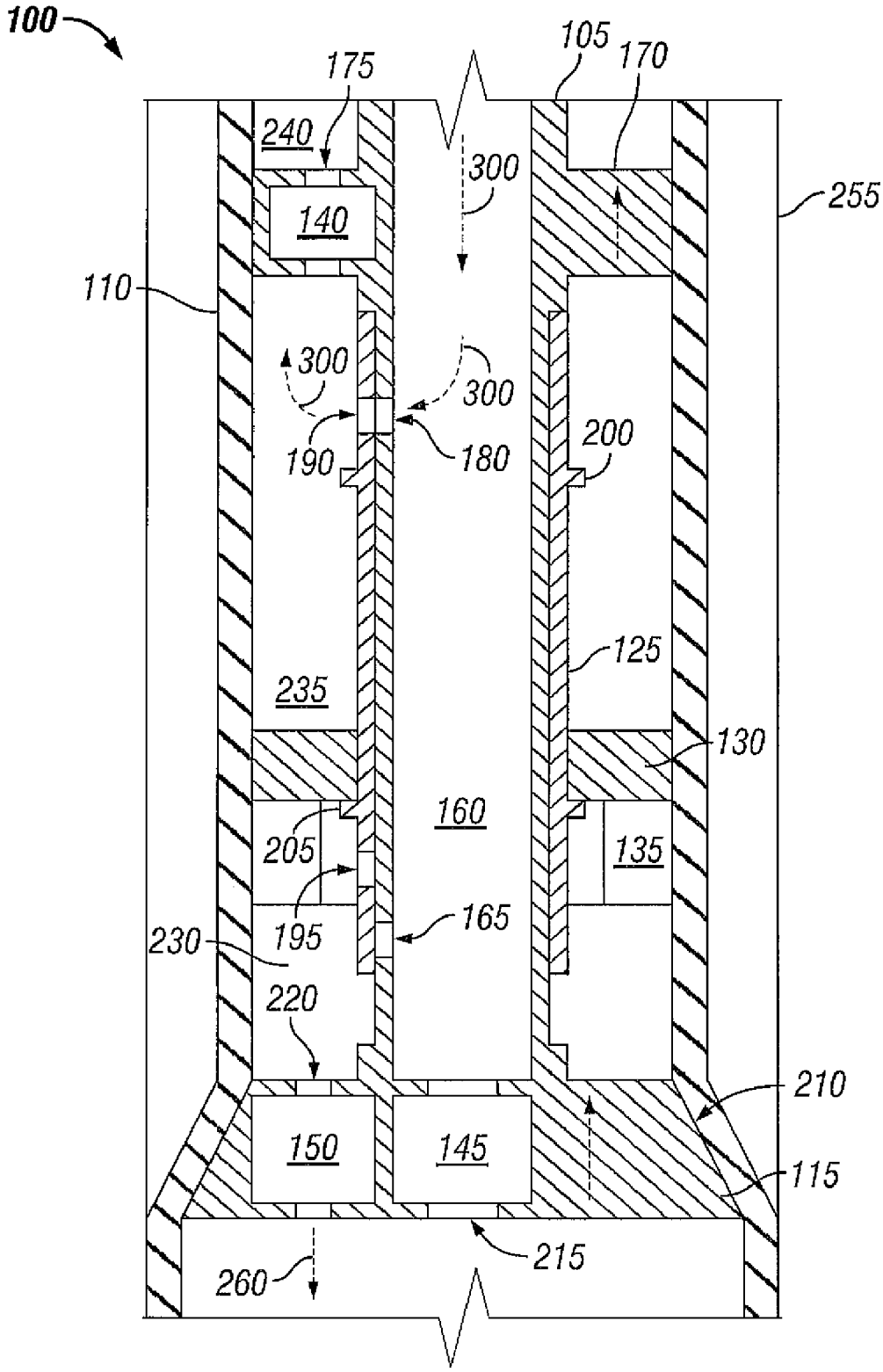
FIG. 6 depicts a cross-sectional view of the system of FIG. 1 when translation of the sleeve with the tubular support member ceases due to contact with the tubular piston.

Continued injection of fluidic material 300 into system 100 maintains pressurization of chamber 235, translation of tubular support member 105 within expandable tubular 110, and expansion of tubular 110 by cone 115. The expansion of tubular 110 continues in this manner until tubular support member 105 translates a sufficient distance upward to cause lower flanged portion 205 of sleeve 125 to contact piston 130, as shown in FIG. 6. After flanged portion 205 contacts piston 130, sleeve 125 is prevented from further upward translation with tubular support member 105.

Figure 7:
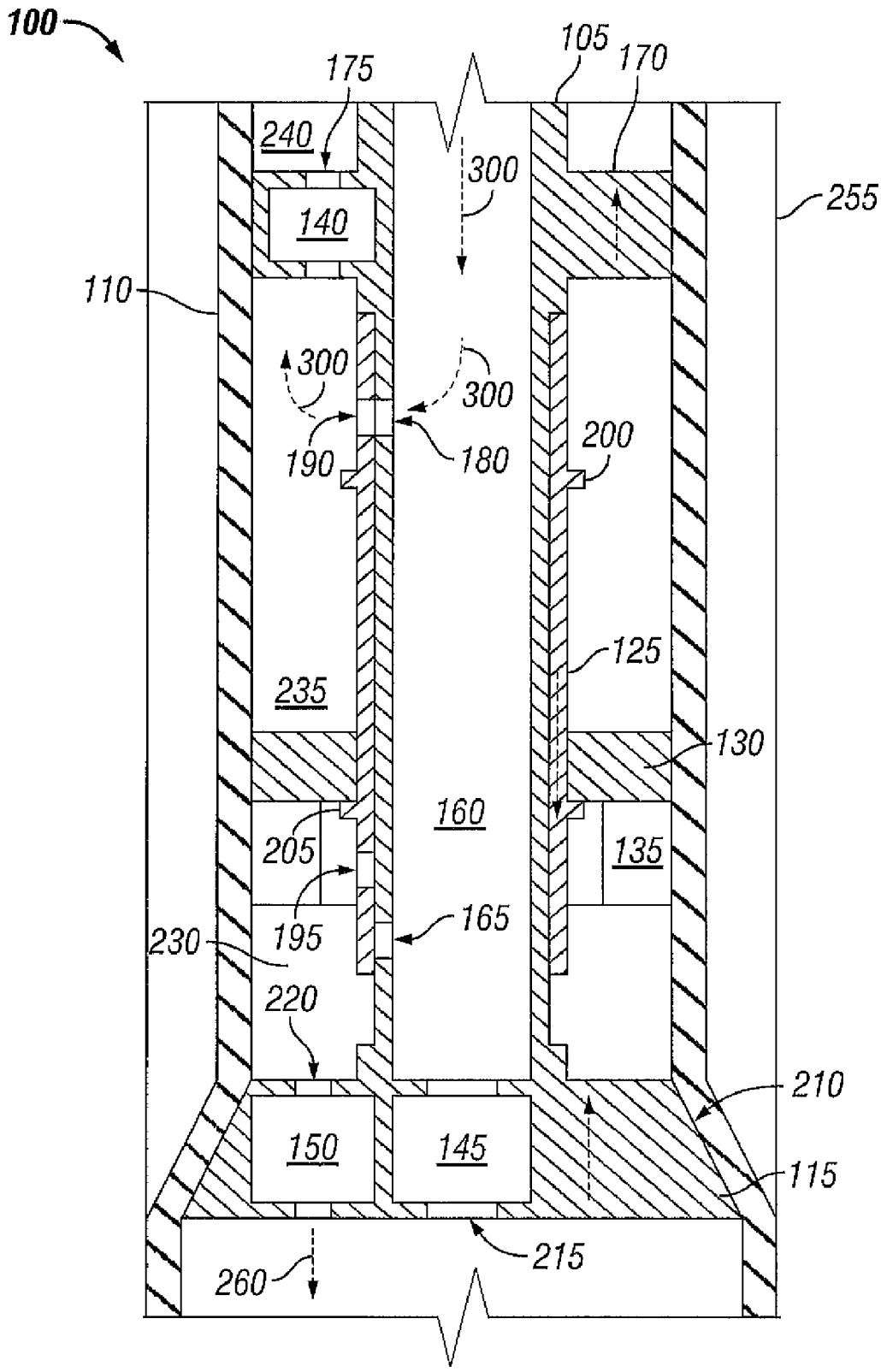
FIG. 7 depicts a cross-sectional view of the system of FIG. 1 as the tubular support member translates relative to the sleeve.
Figure 8:
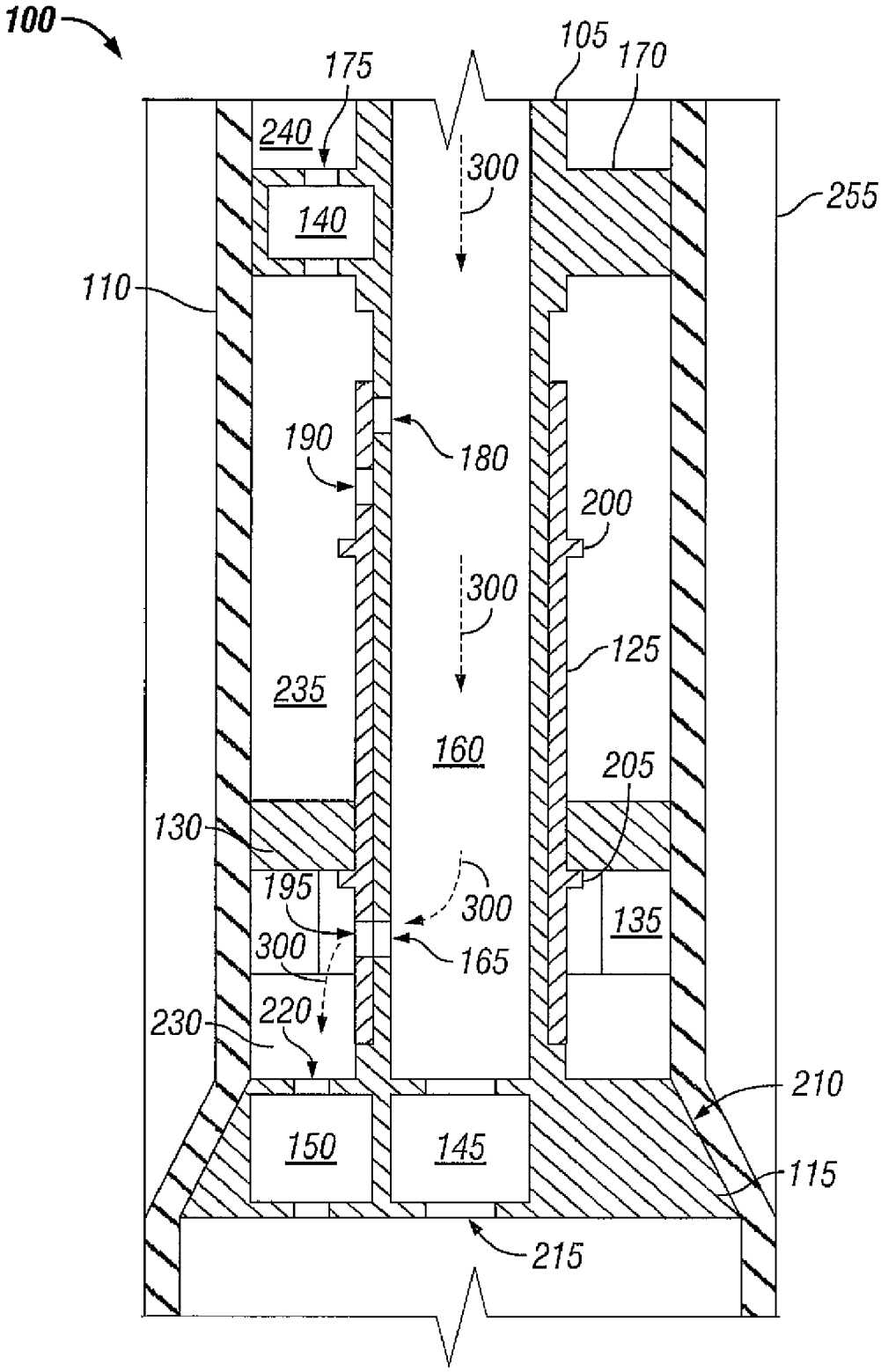
FIG. 8 depicts a cross-sectional view of the system of FIG. 1 when the expansion process is discontinued.

Turning to FIG. 7, continued injection of fluidic material 300 into system 100 causes tubular support member 105 to translate upward relative to sleeve 125 and maintains the expansion process. Eventually, tubular support member 105 translates relative to sleeve 125 such that radial passages 180, 190 are no longer aligned, as shown in FIG. 8. When passages 180, 190 are misaligned, fluidic material 300 ceases to flow into chamber 235, and instead passes into chamber 230 through now-aligned radial passages 165, 195 and exhausts from system 100 through flowbore 220 of expansion cone 115. Because fluidic material 300 has ceased to flow into chamber 235, tubular support member 105 ceases to translate upward relative to expandable tubular 110 and the expansion process is interrupted.

Figure 9:
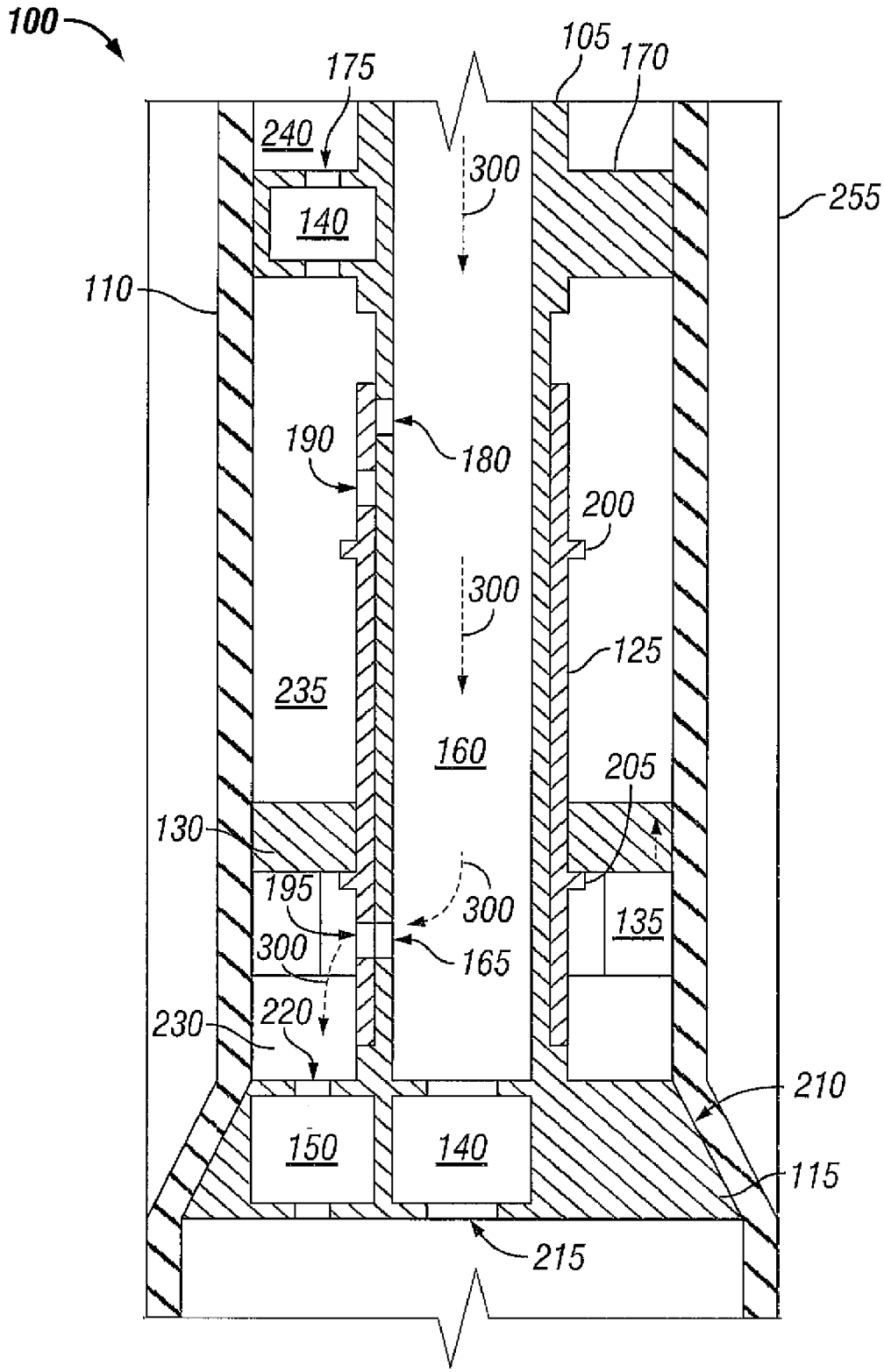
FIG. 9 depicts a cross-sectional view of the system of FIG. 1 at the onset of resetting the system prior to resuming the expansion process.

In order to resume the expansion process, sleeve 125 must be translated relative to tubular support member 105 to again align radial passages 180, 190 and piston 130 moved away from flanged portion 205 to allow sleeve 125 to translate with tubular member 105 when the expansion process resumes. In other words, sleeve 125, piston 130 and slips 135 must be reset to their original positions, defined relative to tubular support member 105 and shown in FIG. 3. To reset system 100, valve 150 is closed, and valve 140 is opened. Continued injection of fluidic material 300 into system 100 then causes pressure buildup within chamber 230 and increasing force to be exerted on piston 130 by fluidic material 300 in chamber 230, as illustrated by FIG. 9.

Figure 10:
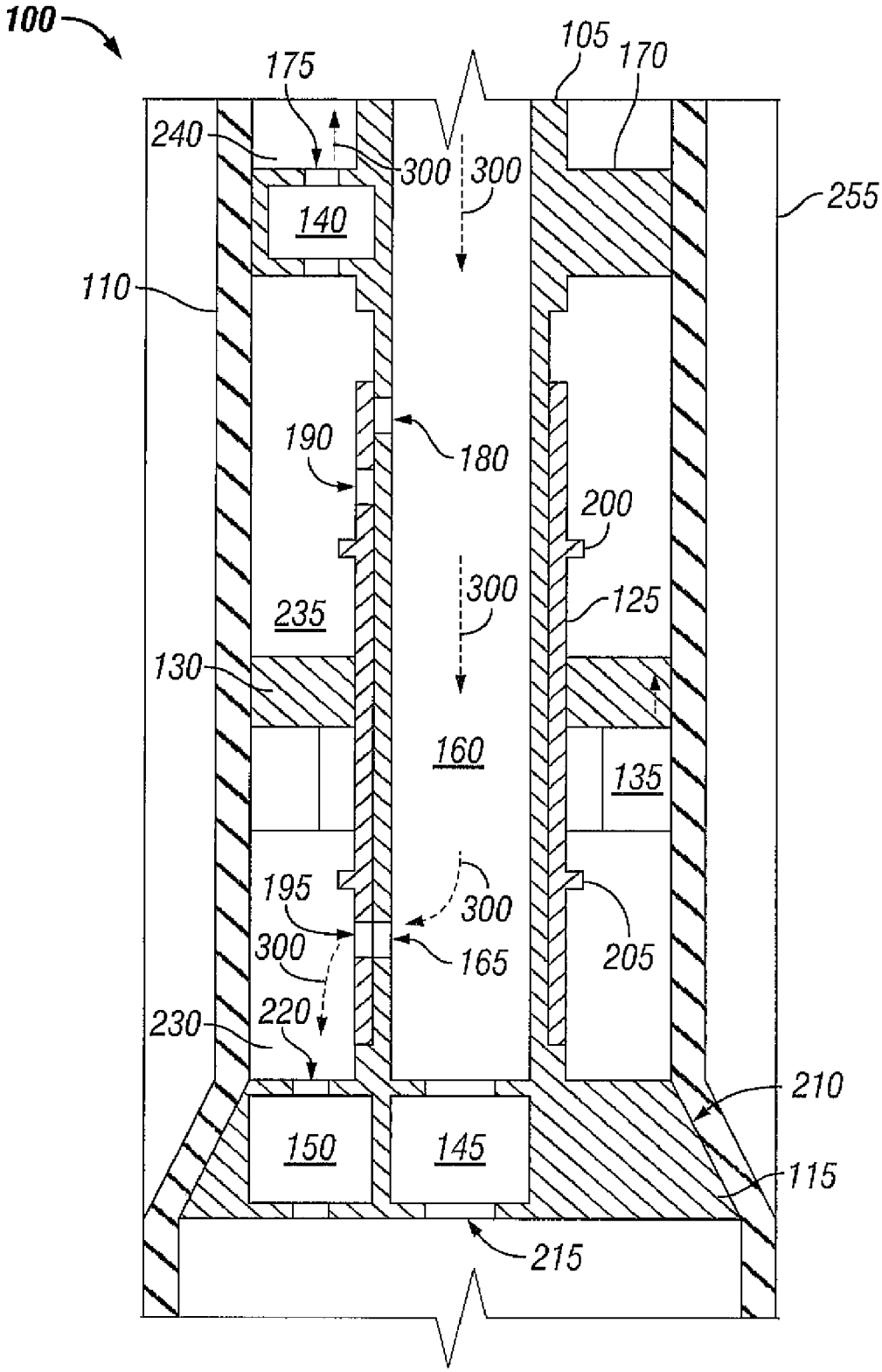
FIG. 10 depicts a cross-sectional view of the system of FIG. 1 as the tubular piston and slips coupled thereto are moved during resetting of the system.

When the pressure of fluidic material 300 in chamber 230 exerts a force on piston 130 sufficient to lift piston 130, slips 135 are actuated to unlock, and piston 130 with slips 135 coupled thereto is translated upward relative to sleeve 125, expandable tubular 110, and tubular support member 105 toward upper flanged portion 200 of support member 105, as illustrated by FIG. 10. At the same time, upward translation of piston 130 causes the volume of chamber 235 to decrease. Valve 140 is open during the resetting of piston 130 to allow fluidic material 300 within chamber 235 to pass from chamber 235 through axial flow passage 175 into chamber 240 as the volume of chamber 235 decreases, thereby minimizing the resistance of material 300 within chamber 235 to upward movement of piston 130.

Figure 11:
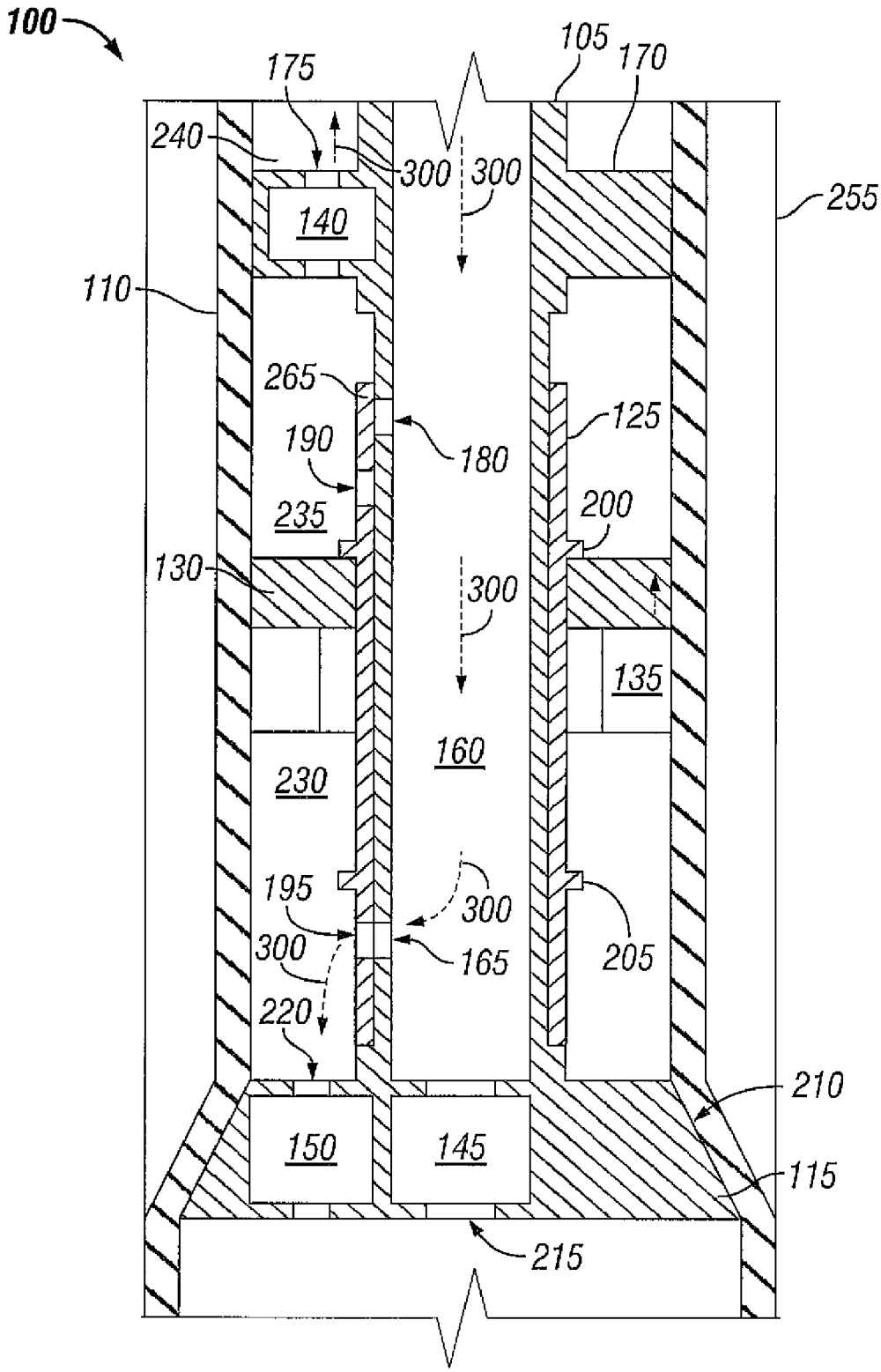
FIG. 11 depicts a cross-sectional view of the system of FIG. 1 when the tubular piston and slips reach their reset positions.
Figure 12:
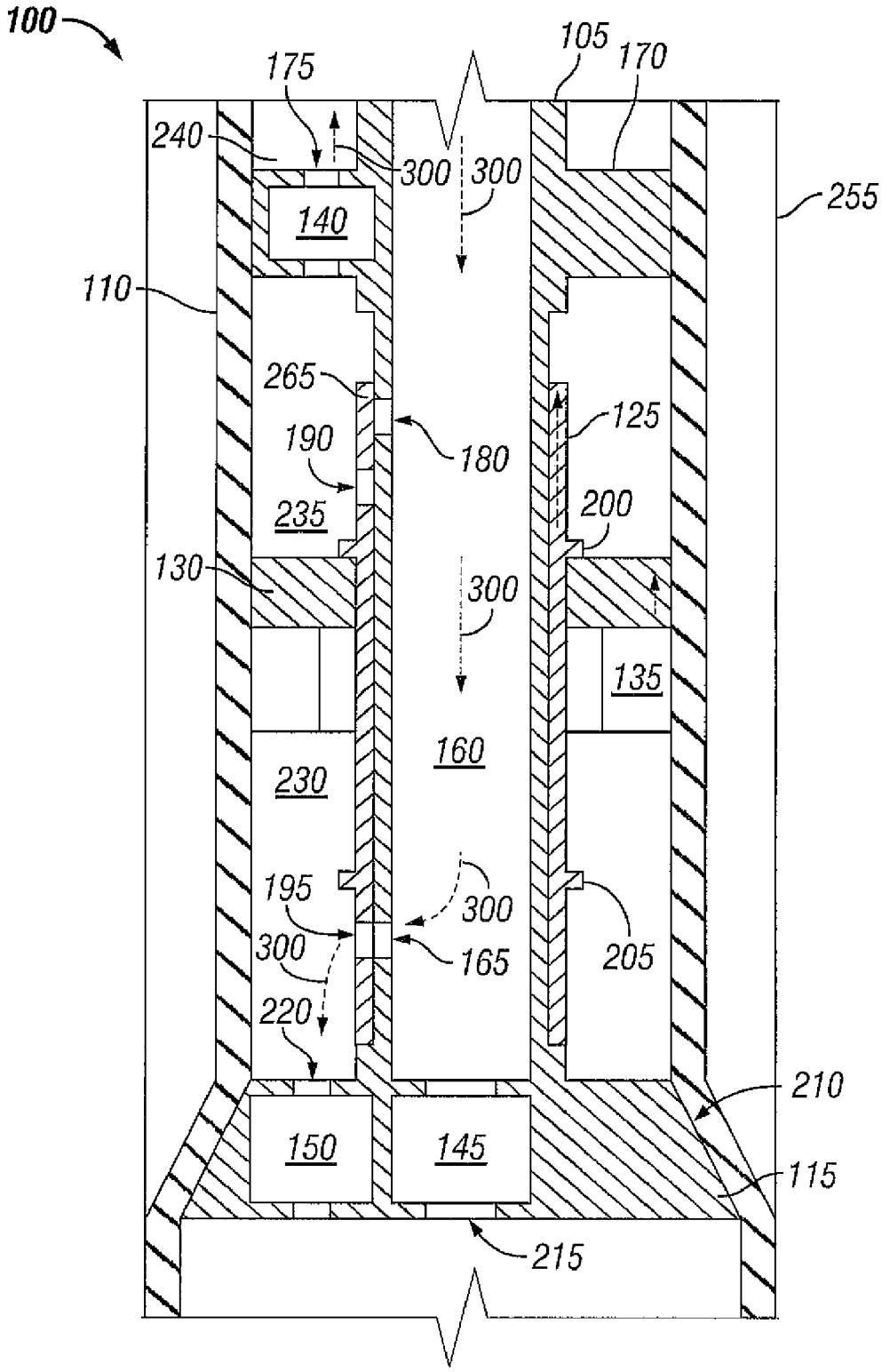
FIG. 12 depicts a cross-sectional view of the system of FIG. 1 when the sleeve reaches its reset position.
Figure 13:
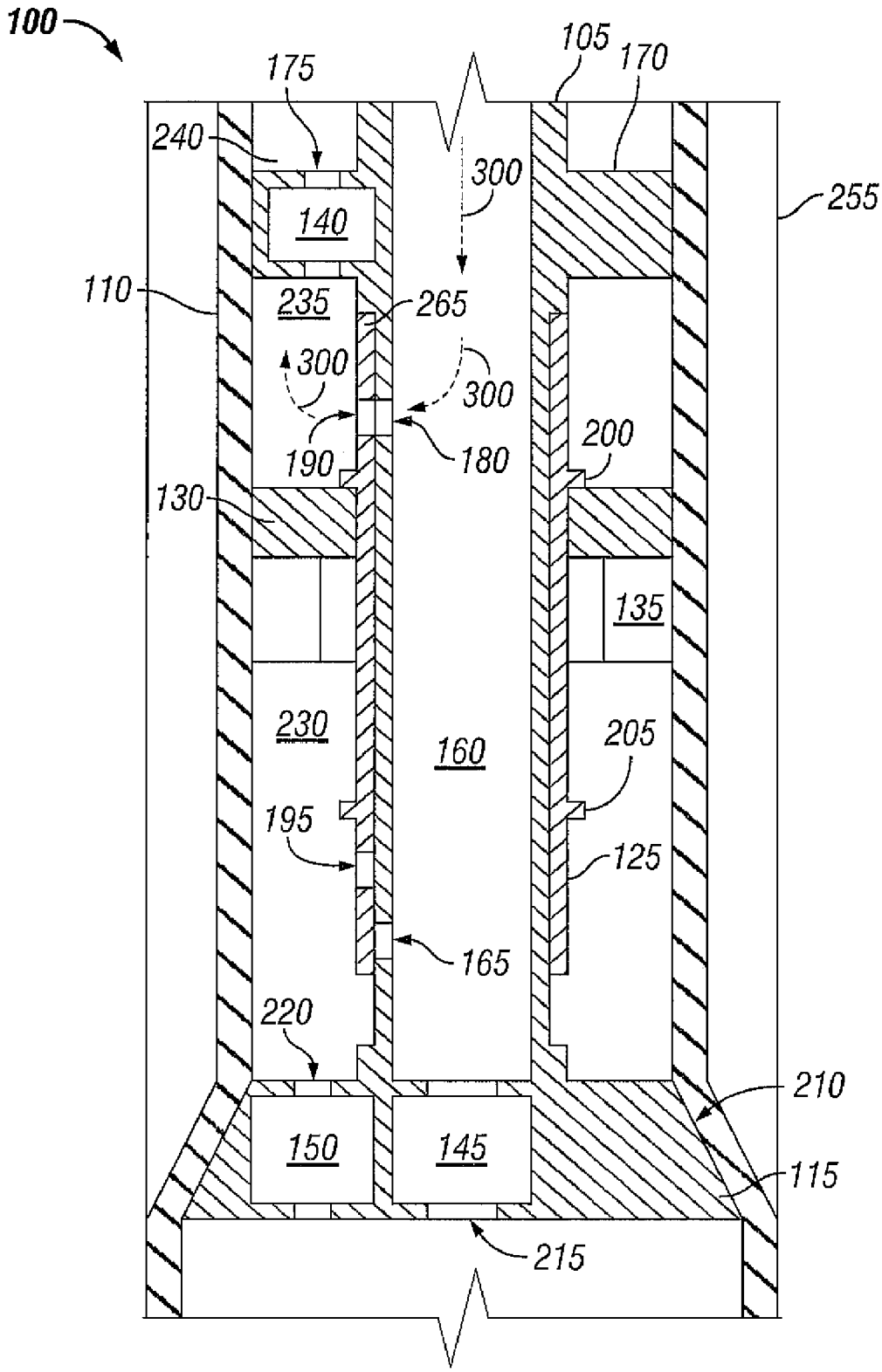
FIG. 13 depicts a cross-sectional view of the system of FIG. 1 when the system is reset and ready to resume the expansion process.

Turning to FIG. 11, piston 130 eventually contacts flanged portion 200 of tubular support member 105. Beyond this point, continued injection of fluidic material 300 causes piston 130 and sleeve 125 by virtue of flanged portion 200 to translate upward relative to tubular support member 105, as illustrated by FIG. 12. When upper end 265 of sleeve 125 abuts tubular support member 105, as shown in FIG. 13, sleeve 125 and piston 130 cease to move upwardly and radial passages 180, 190 are again aligned. Slips 135 are then actuated to lock, fixing piston 130 in engagement with expandable tubular 110. To complete resetting of system 100, valve 140 is closed, and valve 150 is opened.

The reset configuration of system 100 illustrated by FIG. 13 is identical to the configuration of system 100 at the onset of the expansion process illustrated by FIG. 3, but for the position of expansion cone 115 within now partially expanded tubular 110. With system 100 in its reset configuration, the expansion process may be continued by following the same steps described above with reference to and shown in FIGS. 3-13 until the entire length of tubular 110 is expanded. Further, after tubular 110 is expanded into position with wellbore 255, tubular support member 105, expansion cone 115 and other components coupled thereto may be inserted into another expandable tubular 110 and that tubular 110 similarly expanded to increase the length of the wellbore casing. Also, by stacking multiple piston systems 100 and providing appropriate fluid paths, the pressure of injected fluid material 300 required for expansion of tubulars 110 is reduced. This methodology may be repeated until the desired length of wellbore casing is formed within wellbore 255.

Systems and methods for radially expanding and plastically deforming expandable tubulars in accordance with the principles disclosed herein enable the formation of a wellbore casing having a substantially constant diameter, rather than a nested casing arrangement typical of many conventional systems and associated methods. A substantially constant diameter wellbore casing eliminates the need for a relatively large borehole diameter at the upper end of the wellbore and the associated expense. As a consequence, the disclosed systems and methods enable more efficient recovery of hydrocarbons.

While some embodiments have been shown and described, modifications thereof can be made by one skilled in the art without departing from the scope or teachings herein. The embodiments described herein are exemplary only and are not limiting. Many variations and modifications of the systems are possible and are within the scope of the invention. For example, the relative dimensions of various parts, the materials from which the various parts are made, and other parameters can be varied.

What is claimed is:

1. A system for radially expanding an expandable tubular within a wellbore, the system comprising:

a support member insertable within and translatable relative to the expandable tubular, the support member having a tubular body with:

a flowbore extending axially therethrough;

an annular piston extending radially therefrom; and a first radial passage therethrough;

an expansion cone coupled to the support member;

a tubular sleeve translatably disposed about the support member, the tubular sleeve having a second radial passage therethrough; and a tubular piston disposed between the tubular sleeve and the expandable tubular;

wherein the tubular piston, the expandable tubular, the tubular sleeve, and the support member form a first chamber, wherein the first chamber is in fluid communication with the flowbore when the first and second radial passages are aligned.

2. The system of claim 1, wherein the annular piston includes an axial flow passage fluidly coupled to the first chamber.

3. The system of claim 2, further comprising a valve configured to control fluid flow through the axial flow passage.

4. The system of claim 1, wherein the expansion cone comprises an axial flowbore fluidly coupled to the flowbore of the support member and a valve configured to control fluid flow through the flowbore of the expansion cone.

5. The system of claim 1, further comprising a plurality of slips configured to limit translation of the tubular piston relative to the expandable tubular.

6. The system of claim 1, wherein the first chamber is pressurizable by the injection of fluidic material from the flowbore through the first and second radial passages when aligned, wherein the tubular support member translates relative to the expandable tubular, whereby the expansion cone is displaced within the expandable tubular, whereby the expansion cone radially expands a portion of the expandable tubular.

7. The system of claim 1, wherein the tubular sleeve comprises two flanged portions between which the tubular piston is disposed, each flanged portion configured to limit translation of the tubular sleeve relative to the tubular piston.

8. The system of claim 1, wherein the body further comprises a third radial passage, the tubular sleeve further comprises a fourth radial passage, and a second chamber is formed by the expansion cone, the tubular piston, the expandable tubular, the tabular sleeve, and the support member, wherein the second chamber is in fluid communication with the flowbore when the third and fourth radial passages are aligned.

9. The system of claim 8, wherein the second chamber is pressurizable by the injection of fluidic material from the flowbore through the third and fourth radial passages when aligned, wherein the tubular piston translates relative to the support member.

10. The system of claim 9, wherein the expansion cone comprises an axial flow passage fluidly coupled to the second chamber and a valve configured to control fluid flow through the axial flow passage.

11. A system for radially expanding an expandable tubular within a wellbore, the system comprising:

a support member insertable within and displaceable relative to the expandable tubular, the support member having a tubular body with:

a flowbore extending axially therethrough; and a first and a second radial passage therethrough;

an expansion cone coupled to the support member;

a tubular sleeve translatably disposed about the support member, the tubular sleeve having a third and a fourth radial passage therethrough, an annular chamber between the tubular sleeve and the expandable tubular; and a tubular piston disposed in the annular chamber, the tubular piston dividing the annular chamber into a first chamber and a second chamber;

wherein, when the first and the third radial passages are aligned, the flowbore is in fluid communication with the first chamber; and wherein, when second and the fourth radial passages are aligned, the flowbore is in fluid communication with the second chamber.

12. The system of claim 11, wherein the first chamber is pressurizable, whereby the support member displaces relative to the expandable tubular, whereby the expandable tubular is radially expanded.

13. The system of claim 12, wherein the first chamber is pressurizable by injection of fluidic material from the flowbore through the first and third radial passages when aligned.

14. The system of claim 12, wherein the first chamber is pressurizable, whereby the support member displaces relative to the tubular sleeve, whereby radial expansion of the expandable tubular is discontinued.

15. The system of claim 12, wherein the expansion cone comprises an axial flow passage in fluid communication with the second chamber, the axial flow passage configured to exhaust fluid from the second chamber as the first chamber is pressurized.

16. The system of claim 15, further comprising a valve configured to further control fluid flow through the axial flow passage.

17. The system of claim 16, wherein the valve is actuatable between an open position, which permits fluid flow through the axial flow passage, and a closed position, which prevents fluid flow through the axial flow passage.

18. The system of claim 11, wherein the second chamber is pressurizable, whereby the tubular piston displaces relative to the support member, whereby the first and third radial passages align.

19. The system of claim 18, wherein the second chamber is pressurizable by injection of fluidic material from the flowbore through the second and fourth radial passages when aligned.

20. The system of claim 19, wherein the support member comprises an axial flow passage in fluid communication with the first chamber, the axial flow passage configured to exhaust fluid from the first chamber as the second chamber is pressurized.

21. The system of claim 20, further comprising a valve configured to further control fluid flow through the axial flow passage.

22. The system of claim 21, wherein the valve is actuatable between an open position, which pen-nits fluid flow through the axial flow passage, and a closed position, which prevents fluid flow through the axial flow passage.

23. A method for radially expanding an expandable tubular member within a wellbore, the method comprising:

positioning an apparatus within the expandable tubular, the apparatus comprising:

a support member having an axial flowbore, a first radial passage, and a second radial passage extending therethrough;

an expansion cone coupled to the support member;

a tubular sleeve translatably disposed about the support member, the tubular sleeve having a third and a fourth radial passage therethrough;

an annular chamber between the tubular sleeve and the expandable tubular; and a tubular piston disposed in the annular chamber, the tubular piston dividing the annular chamber into a first chamber and a second chamber;

aligning the first and the third radial flow passages to establish fluid communication between the flowbore and the first chamber;

injecting fluidic material from the flowbore into the first chamber; and displacing the support member relative to the expandable tubular, whereby the expansion cone radially expands a portion of the expandable tubular.

24. The method of claim 23, further comprising interrupting the injecting of fluidic material into the first chamber, whereby radial expansion of the expandable tubular is discontinued.

25. The method of claim 24, wherein the interrupting comprises translating the support member relative to the sleeve, whereby the first and the third radial passages misalign.

26. The method of claim 25, further comprising reestablishing the injection of fluidic material into the first chamber, whereby radial expansion of the expandable tubular resumes.

27. The method of claim 26, wherein the reestablishing comprises:

aligning the second and the fourth radial flow passages to establish fluid communication between the flowbore and the second chamber;

injecting fluidic material from the flowbore into the second chamber; and displacing the tubular piston relative to the support member, whereby the sleeve is displaced relative to the support member, whereby the first and the third radial passages align.

28. The method of claim 27, wherein misaligning the first and the third radial passages aligns the second and the fourth radial passages.

* * * * *